US006354213B1

(12) United States Patent
Jenkins

(10) Patent No.: US 6,354,213 B1
(45) Date of Patent: Mar. 12, 2002

(54) METHOD AND APPARATUS FOR CLEANING A METERING ROLL OF A PRINTING PRESS

(76) Inventor: Jerome D. Jenkins, 18550 Longview Ct., Brookfield, WI (US) 53045

( * ) Notice: Subject to any disclaimer, the term of this patent is extended or adjusted under 35 U.S.C. 154(b) by 0 days.

(21) Appl. No.: 09/541,636

(22) Filed: Apr. 3, 2000

(51) Int. Cl.[7] ..... B41C 1/05
(52) U.S. Cl. ..... 101/483; 101/487
(58) Field of Search ..... 101/483, 424, 101/423, 425, 424.1, 488, 487

(56) References Cited

U.S. PATENT DOCUMENTS 3,654,864 A * 4/1972 Ovshinsky ..... 101/467
4,566,938 A 1/1986 Jenkins et al.
5,592,879 A * 1/1997 Waizmann ..... 101/423
5,958,268 A * 9/1999 Engelsberg et al. .... 219/121.84
6,109,175 A * 8/2000 Kinoshita ..... 101/483
6,131,266 A * 10/2000 Saunders ..... 29/557

* cited by examiner

*Primary Examiner*—John S. Hilten
*Assistant Examiner*—Anthony Nguyen
(74) *Attorney, Agent, or Firm*—Robert J. Harter

(57) ABSTRACT

An apparatus and method for cleaning a metering roll having a composite sleeve or a metal core with a ceramic coating involves the use of a laser. The roll's ceramic coating is covered with a matrix of cells that can get plugged with a polymeric contaminant, such as dried ink. The laser is uniquely focused to provide a beam intensity profile that matches multiple curved surfaces of the cells. The laser applies heat to each cell at a temperature that destroys the contaminant, yet leaves the ceramic coating intact. The heat is rapidly delivered and rapidly removed from the roll to minimize the amount of heat conducted to the roll's metal core. In addition, a special pneumatic guide bearing makes it possible to clean the metering roll while it is still in the printing press.

6 Claims, 4 Drawing Sheets

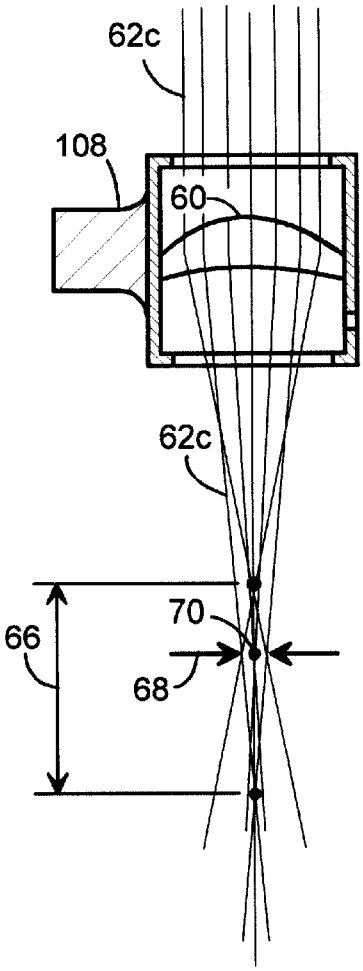
FIG. 4A
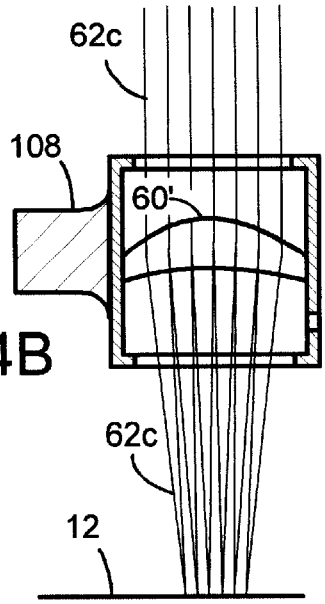
FIG. 4B
FIG. 2
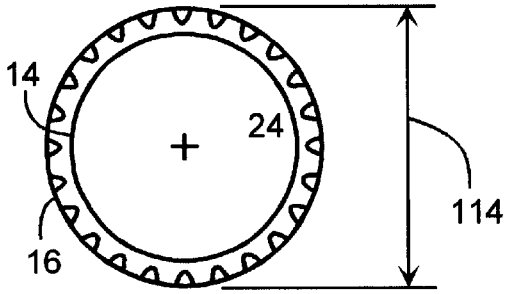
FIG. 3
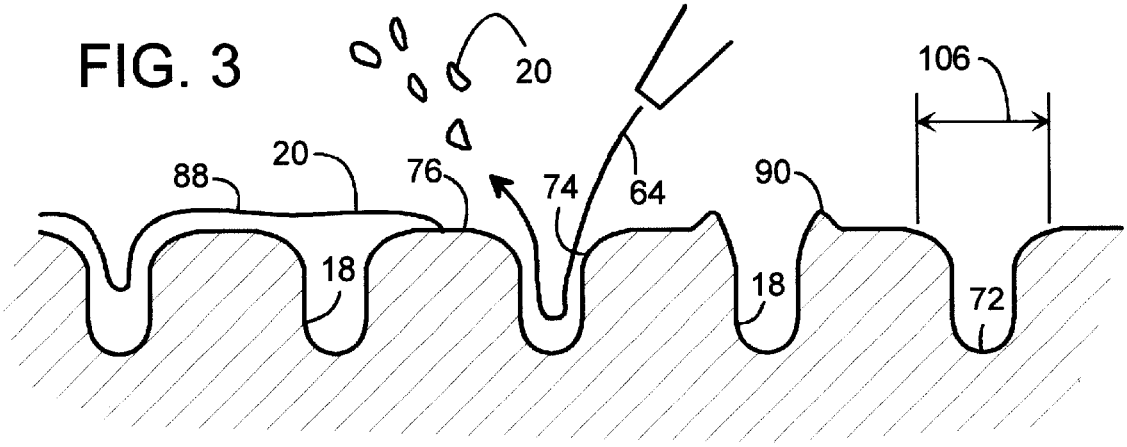

METHOD AND APPARATUS FOR CLEANING A METERING ROLL OF A PRINTING PRESS

BACKGROUND OF THE INVENTION

1. Field of the Invention

The subject invention generally pertains to the metering roll of a printing press, and more specifically to cleaning the metering roll.

2. Description of Related Art

In a printing process, a metering roll (anilox roll) transfers ink to a plate, which in turn applies the ink to the material being printed, such as paper or a consumer product label. Some metering rolls have a ceramic coating covered with a dense matrix of extremely small cells that hold the ink. Over time, the cells get plugged with dried or otherwise cured ink which reduces the effectiveness of the roll.

Currently, metering rolls are cleaned of their contaminants (e.g., dyes, ink, binders, plasticizers, etc.) with strong solvents, soda blasting, and ultrasonic processes. These methods, however, have limited effectiveness and serious drawbacks.

Many water-based dyes and inks are resistant to common solvents. Some solvents can no longer be used, because of their negative effect on the environment. Since ceramic can be porous, some solvents and/or chemicals penetrate completely through the ceramic coating to attack the roll's metal core. This can lead to the ceramic coating separating from the roll. Excessive heating can also damage the interface between the roll's metal core and the ceramic, due to the differences of their thermal expansion properties. Ultrasonic and soda blast cleaning can physically damage the ceramic itself. And today's conventional methods of cleaning require that the metering roll be removed from the printing press. Moreover, there is a trend toward providing metering rolls with ever smaller hole diameters, which make the cells even more difficult to clean.

SUMMARY OF THE INVENTION

To avoid the limitations and problems of existing methods of cleaning metering rolls, it is an utmost primary object of the invention to shape the intensity distribution of a laser beam to match the curved geometry of the cells of a ceramic coated metering roll.

A second object of the invention is to employ an anilox cell geometry that promotes a smooth pattern of airflow delivered by an air nozzle that provides an angled approach.

A third object is to focus a laser beam toward a focal point that is below the bottom of the cell being cleaned.

A fourth object is to use heat to destroy the contaminants of a metering roll while minimizing the heat conducted to the roll's metal core.

A fifth object is to provide a non-contact method of removing contaminants from a plugged metering roll, regardless of the hole diameter of the cells.

A sixth object is to clean a metering roll without having to remove it from the printing press.

A seventh object is to turn the laser beam off as it passes between cells to minimize the heat delivered to the roll.

An eighth object is to employ a guide bearing that maintains a constant separation distance between the lens and the ceramic surface of the metering roll, regardless of slight misalignments of the cleaning apparatus and cylindrical discrepancies of the roll.

A ninth object is to have the laser beam target travel in a helical pattern around a metering roll, with the pattern being superimposed on a similar helical pattern of cells.

A tenth object of the invention is to adjust the focus of the laser beam by test burning the ink off a paper label.

An eleventh object of the invention is to rotate a metering roll using a "non-slip" synchronous motor whose speed is substantially constant, regardless of slight variation in torsional load.

A twelfth object is to compensate for limited encoder resolution by periodically delaying the firing time of the laser in response to an encoder compensation input.

These and other objects of the invention are provided by a novel apparatus and method for cleaning a ceramic coated metering roll. The method uses a laser that is uniquely focused to provide a beam intensity profile that suits the multiple curved surfaces of cells that are plugged with a polymeric contaminant. The laser applies heat to the roll at a temperature that destroys the contaminant yet leaves the ceramic coating intact. The heat is rapidly delivered and rapidly removed from the roll to minimize the amount of heat conducted to the roll's metal core.

BRIEF DESCRIPTION OF THE DRAWINGS

FIG. 2 is a cross-sectional view taken along line 2—2 of the metering roll of FIG. 1.

FIG. 3 is an enlarged cross-sectional view of the cells in the roll of FIG. 1.

FIG. 4A illustrates the focusing characteristics of a lens according to one embodiment of the invention.

FIG. 4B illustrates the focusing characteristics of a lens according to another embodiment of the invention.

DESCRIPTION OF PREFERRED EMBODIMENTS

Figure 1:
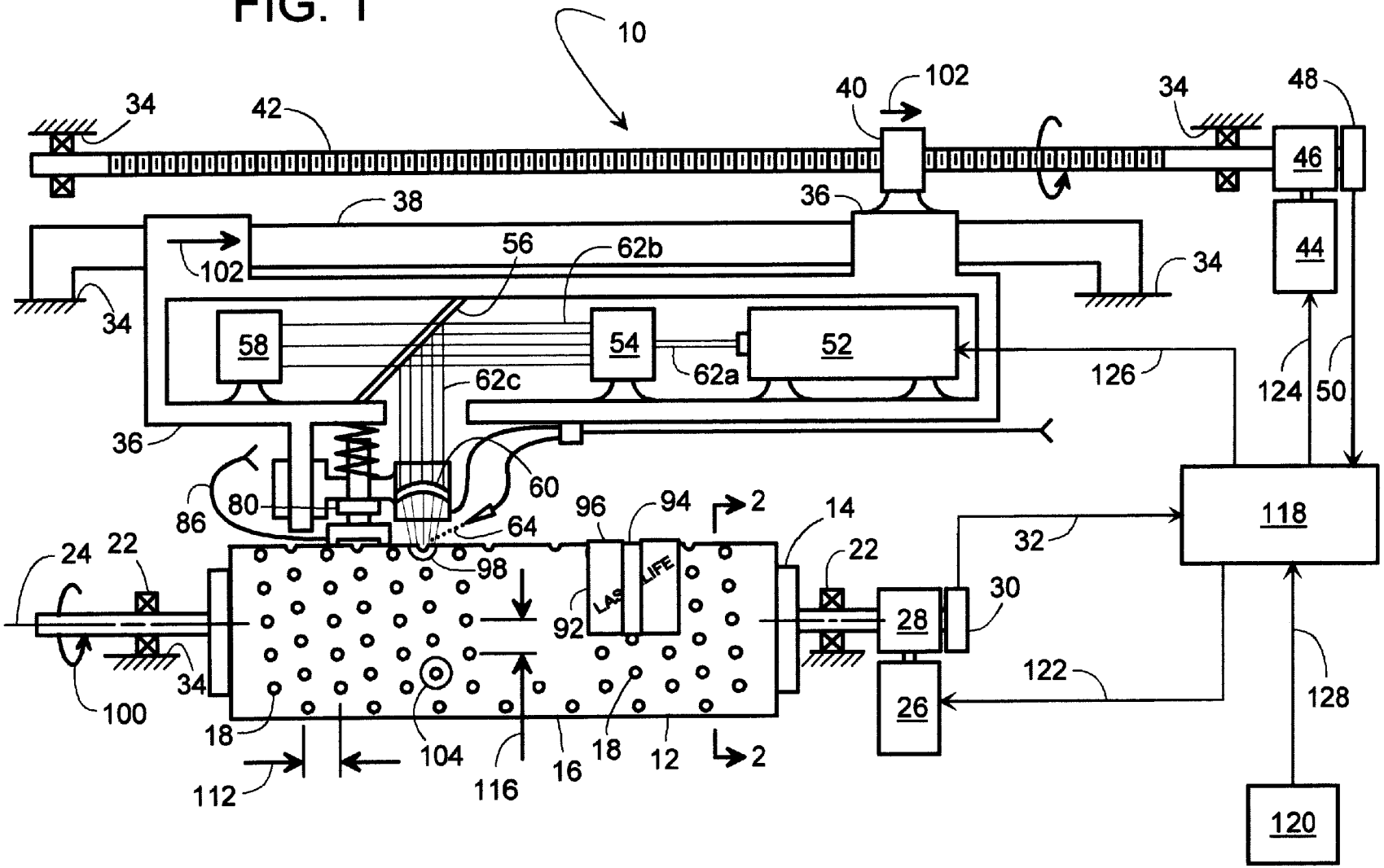
FIG. 1 is a schematic view of a cleaning apparatus cleaning a metering roll.

A metering roll cleaning apparatus 10, of FIG. 1, is cleaning a metering roll 12. Details and examples of a metering roll can be found in U.S. Pat. No. 4,566,938, which is specifically incorporated by reference herein. Roll 12, as also shown in FIG. 2, has a metal core 14 (e.g., steel) with a coating 16 (e.g., ceramic, nickel, copper, chrome and various combinations and layers thereof). Coating 16 has a plurality of cells 18 that are used for holding a dye (e.g., ink) and subsequently transferring the dye onto a plate (not shown) of a printing press or directly to a substrate. It should be noted that in a preferred embodiment of the invention, coating 16 consists of a ceramic material; however, coating 16 actually represents any coating material having thermal properties that are dissimilar to those of metal core 14. For example, in one embodiment of the invention, coating 16 is chrome plating over a steel roll that has mechanically engraved or chemically etched porosity for holding the dye.

In other words, roll 12 encompasses rolls having a metal core base as well as the latest technology of a roll having a composite sleeve base.

In time, the dye may dry or cure on roll 12 to produce a polymer contaminant 20 that plugs cells 18, as shown in FIG. 3. Polymer contaminant 20 represents any one of a variety of substances including (but not limited to) inks, dyes, binders, plasticizers, ultraviolet cured photo-polymers, and adhesives.

Returning to FIG. 1, apparatus 10 serves to remove contaminant 20 from roll 12. Apparatus 10 includes bearings 22 that rotatably mount roll 12 about a longitudinal axis 24. Roll 12 is rotatably driven by a synchronous motor 26 through a gear reducer 28. An encoder 30, coupled to the rotation of roll 12, generates a pulsed feedback signal 32 representing the rotational speed of rotor 12. A first datum 34 represents a generally fixed frame of reference. In one embodiment of the invention, datum 34 represents the frame of a printing press where roll 12 is cleaned without being removed from its press. In such an application, bearings 22 are integral components of the press. In another embodiment of the invention, datum 34 represents an independent frame, separate from the printing press, so roll 12 can be removed from the press and cleaned at a remote location.

A guideway 38, fixed relative to datum 34, slidingly guides a support frame 36. Support frame 36 is driven in a direction generally parallel to longitudinal axis 24 by way of a nut 40 coupled to a leadscrew 42. Leadscrew 42 is driven by a motor 44 through a gear reducer 46. An encoder 48 provides a feedback signal 50 representing the longitudinal position of frame 36 in relation to guideway 38.

Attached to frame 36, is a laser 52, a beam expander 54, a partial reflector 56, a beam analyzer 58, and a lens, such as lens 60 or lens 60'. Laser 52 emits a narrow concentrated laser beam 62*a*. Beam expander 54, downstream of laser 52, widens beam 62*a* to create beam 62*b* having a lower intensity (energy level per unit of area). Partial reflector 56, downstream of beam expander 54, passes 1% of beam 62*b* onto beam analyzer 58 for monitoring the intensity distribution of beam 62*b*. Reflector 56 reflects 99% of beam 62*b* to project a beam 62*c* onto lens 60, which is downstream of reflector 56.

Lens 60 focuses beam 62*c* toward roll 12 to destroy (by heat) contaminant 20 in and around cells 18. Once destroyed, a pressurized fluid, such as air 64, blows contaminant 20 out of cells 18. Motor 26 continuously turns roll 12, while motor 44 continuously feeds frame 36 longitudinally, so that laser beam 62*c* traverses all of cells 18 to clean substantially the entire ceramic coating 16.

Figure 5:
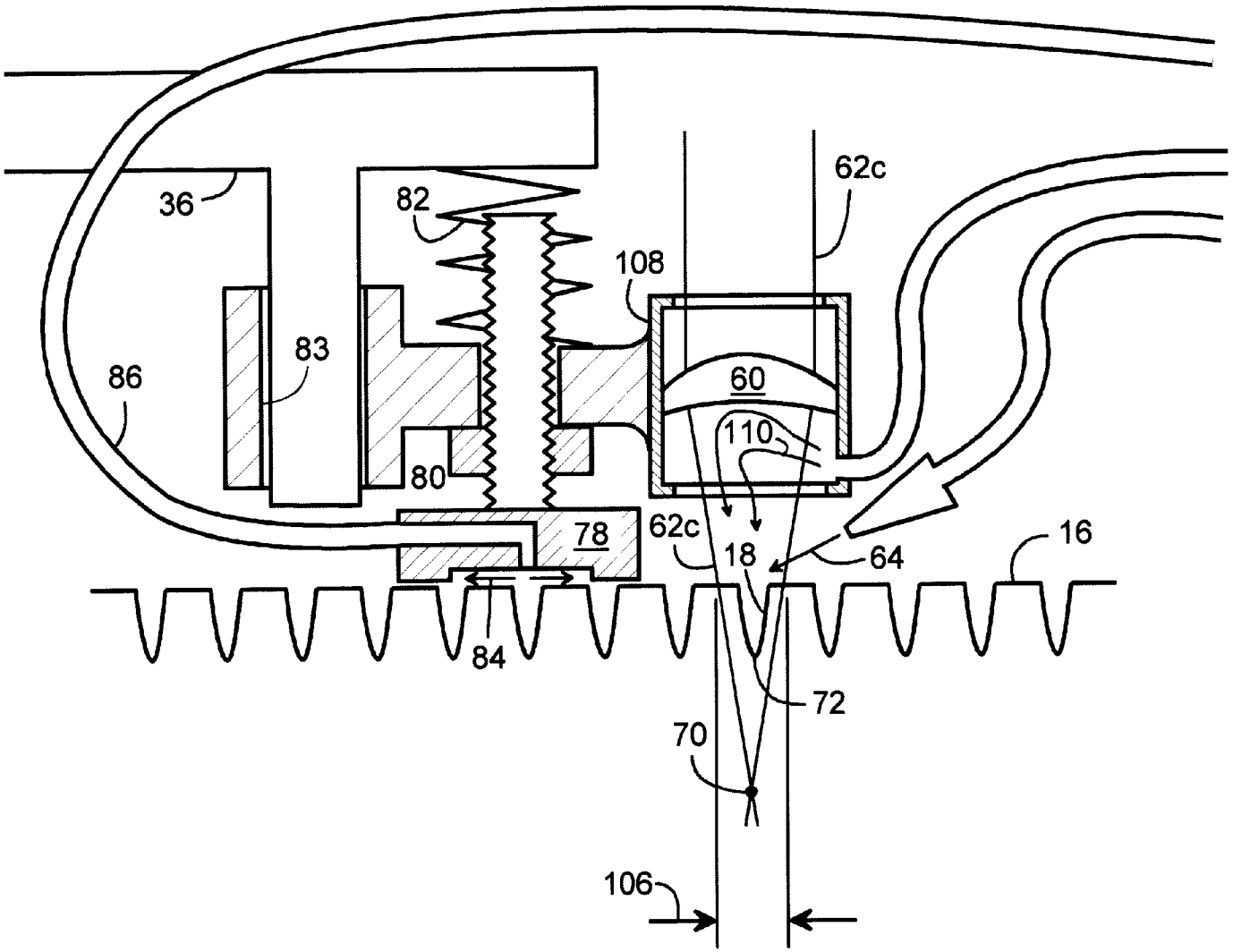
FIG. 5 is another schematic view of the invention showing the lens and guide bearing.
Figure 7A:
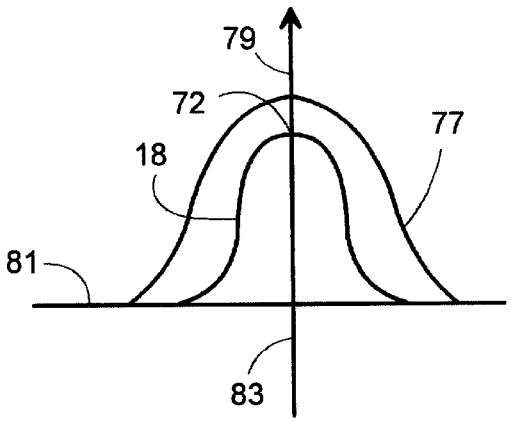
FIG. 7A shows the power intensity profile of a laser beam superimposed on the geometry of a cell according to one embodiment of the invention.

It has been found that the cleaning process is most effective when particular attention is given to focusing beam 62*c*. Referring to FIG. 4A, lens 60 focuses beam 62*c* to a number of points to define a length of spherical aberration 66. Within spherical aberration 66, beam 62*c* converges to a minimum width 68 (i.e., spotsize) referred to as a focal point 70. Surprisingly, best results are obtained when the position of lens 60 is set to place focal point 70 below a curved bottom surface 72 of cells 18, as shown in FIG. 5. This setup contours the profile of the beam intensity over the distance from the center of beam 62*c* to suit the contour of the cell's curved bottom 72, the cell's rounded beveled entryway 74, and an annular area 76 surrounding each cell 18. The fit between the intensity distribution 77 of beam 62*c* superimposed on the geometry of cell 18 is shown in FIG. 7A. The ordinate 79 with reference to distribution 77 is in terms of energy per unit of area (e.g., watts/cm$^2$), while the abscissa 81 is the radial distance from the center 83 of beam 62*c*.

To maintain the proper focus, a guide bearing 78 holds lens 60 at the desired distance from ceramic coating 16; regardless of discrepancy of the cylindricity of roll 12, and regardless of possible slight out of parallelism between guideway 38 and axis 24.

The distance between lens 60 and roll 12 is adjustable by virtue a threaded coupling 80 that opposes a compression spring 82. A slide 83 allows spring 82 to urge lens 60 toward ceramic coating 16 (It should be noted that the spring, slide and adjustment features are schematically illustrated). In one embodiment of the invention, bearing 78 is fluid dynamically spaced apart from ceramic coating 16 by a thin cushion of pressurized air 84 supplied through hose 86. Air cushion 84 minimizes the effects of possible irregularities, such as contaminant buildup 88 and ceramic protrusions 90.

Figure 6:
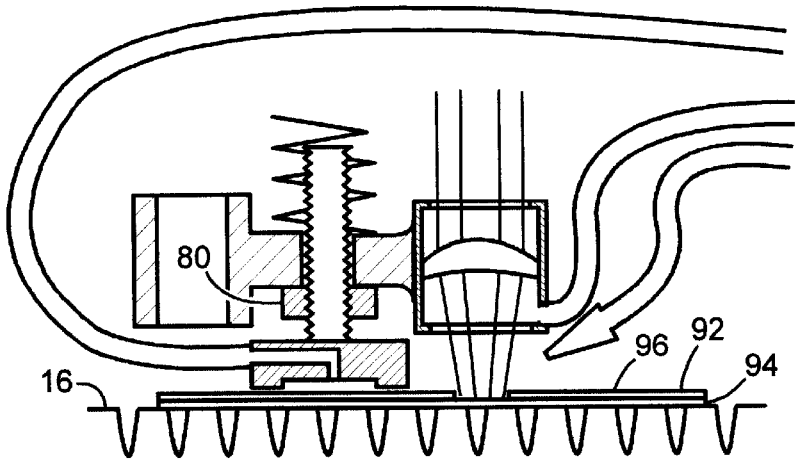
FIG. 6 shows the setup for adjusting the focus by using a test decal.

One method of adjusting coupling 80, to set the proper focus, is done by first applying an adhesive backed test decal 92 to roll 12, as shown in FIG. 6. Decal 92 has a base material 94 of paper with a printed dye coating 96. A conventional consumer product label would be one example of decal 92. Laser 52 is controlled to pass across decal 92 while coupling 80 is adjusted until beam 62*c* burns ink 96 off decal 92 without doing substantial damage to the decal's base material 94.

In cleaning ceramic coated metering roll 12, it is important to take into account the material property dissimilarities of the roll's metal core 14, ceramic coating 16, and polymeric contaminant 20. In particular it is not unusual for there to be a 20% difference in the coefficient of thermal expansion between steel and ceramic, and steel can have 50% higher thermal conductivity than ceramic. In addition, common polymeric contaminants, steels, and ceramics have a wide range of disassociation temperatures (i.e., temperature at which the material melts, burns, breaks down, or otherwise changes significantly in its state or physical properties). The polymeric disassociation temperature of many dried or cured printing dyes is typically between 300° F. to 600° F. The ceramic disassociation temperature of many ceramics is about 3,000° F. to 4,000° F.; while common steels melt at a temperature of around 2,700° F. to 2,900° F.

When using a laser 52 to clean ceramic coated metering roll 12, excessive heat may lead to thermal cracking and separation between metal core 14 and ceramic coating 16, due to their differences in thermal properties. Referring back to FIG. 1, it has been found that heating a first region 98 of ceramic coating 16 to a temperature of between 400° F. to 1,000° F. effectively destroys common polymeric contaminants 20 while leaving ceramic 16 substantially intact. Blowing ambient air 64 (at a temperature below the polymeric disassociation temperature) not only clears contaminants from cells 18, but also serves to cool region 98 and minimize the amount of heat that can penetrate to metal core 14. By subsequently changing the circumferential and longitudinal position of roll 12 relative to laser beam 62*c* (as indicated by arrows 100 and 102, respectively), region 98 is allowed to cool further to a level below the polymeric disassociation temperature. Eventually, a second region 104 is cleaned in the same manner as the first.

The size of regions 98 and 104 subjected to beam 62*c* are wide enough to not only clean each cell 18, but to also clean annular area 76 (FIG. 3) surrounding each cell 18. Preferably, regions 98 and 104 are at least twice as wide as a widest span 106 of cells 12.

To enhance the cleaning process, each cell 18 has a rounded beveled entryway 74 and a curved bottom surface 72 to readily receive, redirect, and exhaust pressurized air 64 in and out of each cell 18. The cell geometry and the approach angle of air 64 provides a smooth airflow pattern that facilitates expelling contaminant 20 from cells 18, as shown in FIG. 3.

Another supply of pressurized ambient air is delivered into a housing 108 that holds lens 60 (see FIG. 5). The airflow pattern 110 travels generally away from lens 60 and toward cells 18 to protect lens 60 from being struck by fragments of polymeric contaminants 20.

A further enhancement of the cleaning process involves pulsating laser beam 62*a*–62*c* on and off for individually firing at each individual cell 18. This is done by setting the timing and frequency of the pulses in synchronization with both the circumferential and longitudinal repositioning of cells 18 relative to beam 62*c*. In one embodiment of the invention, motor 26 is a synchronous motor that turns at a substantially constant speed to change the rotational position of roll 12 at a substantially constant rate of rpm (revolutions per minute). The longitudinal feed motor 44 is also a synchronous motor having a substantially constant speed. The speed of motor 44 is set as a function of the rotational speed (e.g., rpm.) of motor 26, a longitudinal spacing 112 between adjacent cells 18, and, of course, the mechanical characteristics of lead screw 42 and gear reducers 28 and 46. The speed relationship between motors 26 and 44 is analogous to turning threads on a lathe. With the motor speeds properly set in relation to each other, the region (e.g., regions 98 and 104) illuminated by beam 62*c* will inscribe a helical pattern. The pattern is superimposed upon the helical distribution of cells 18 by adjusting the timing and frequency of the on/off pulsating of laser 62*a*.

The pulsating frequency of laser 52 is set as a function of the rotational speed (rpm) of roll 12, a diameter 114 of roll 12, and a circumferential separation distance 116 between two adjacent cells. The pulsating frequency of laser 52 is set equal to the frequency at which cells 18 pass across the path of laser beam 62*c*. The timing of the beam pulses serve to align the phase of the frequency at which cells 18 pass across the path of beam 62*c* to the phase of the pulsating frequency of laser 52.

Although controlling the pulsating frequency of laser 52 and the speed of motors 26 and 44 can be carried out by any one of a variety of conventional control means available to those skilled in the art, in one embodiment of the invention, a computer based control 118 having a manual input 120 (e.g., keyboard, monitor with touch-sensitive screen, etc.) is used.

Control 118 generates a rotational speed signal 122 and a longitudinal speed signal 124 that establishes the speed of motors 26 and 44, respectively. Accurate feedback on the rotation of motors 26 and 44 are provided by encoders 30 and 48 which respectively generate the encoder feedback signals 32 and 50. Manual input 120 provides input regarding the physical distribution of cells 18 for establishing target speeds of motors 26 and 44 and also for establishing a target frequency at which laser 52 is to be pulsating on and off. Control 118 provides an output signal 126 that triggers laser 52 upon control 118 counting a predetermined number of pulses 32 since the last firing. Once operating, the firing of laser 52 is fine tuned manually. This is done by observing the cleaning results of the first few cells and then providing control 118 with an encoder compensation signal 128 via manual input 120. Signal 128 tells control 118 to add an extra pulse to its count of pulses from encoder 32 periodically after a predetermined number of firings. The duration of each laser beam pulse is set by way of manual input 120 after referencing beam analyzer 58.

In one embodiment of the invention, beam expander 54, lens 60 (P/N 285767), and partial reflector 56 (P/N 0405-2000) are provided by II–VI Incorporated of Saxonburg, Pa. And beam analyzer 58 is a Model LBA-300 PC provided by Spiricon of Ogden, Utah.

Figure 7B:
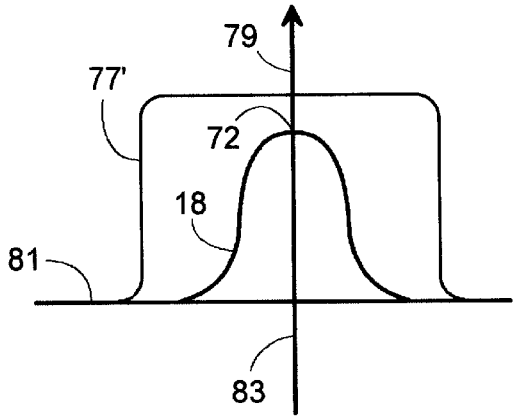
FIG. 7B shows the power intensity profile of a laser beam superimposed on the geometry of a cell according to another embodiment of the invention.

In another preferred embodiment, shown in FIG. 4B, lens 60 is replaced by lens 60', which is also known as a transmissive beam integrator and is provided by Laser Power Optics of San Diego, Calif. Lens 60' consists of a diamond turned optical component that slices high power beam 62*c* into segments and overlaps the segments generally at the surface of roll 12. This produces a generally uniform energy distribution 77', as shown in FIG. 7B. However, rather than a Gaussian or normal distribution over a circular area, as produced by lens 60, lens 60' focuses a substantially uniform energy distribution over a generally square area. Such an energy distribution should prove most effective in cleaning rolls that are contaminated with a coating of generally uniform thickness.

Although the invention is described with respect to a preferred embodiment, modifications thereto will be apparent to those skilled in the art. Therefore, the scope of the invention is to be determined by reference to the claims which follow.

I claim:

1. A method of cleaning a metering roll of a printing press, said metering having a metal core with a ceramic coating, said ceramic coating having a plurality of cells each having a bottom, each having a widest span, and each containing a polymeric contaminant, said method comprising the steps of:

pulsating a laser beam on and off to individually fire at each of said plurality of cells;

focusing said laser beam at a first region of said ceramic coating with said first region containing a first cell of said plurality of cells, said first region being at least twice as wide as said widest span of said first cell, said laser beam being focused toward a focal point defined as that point in space where said laser beam converges to a minimum width if it were unobstructed, said focal point being below said bottom of said first cell when focusing said laser beam at said first region;

raising the temperature of said first region to 400° F. to 1,000° F. which is above a polymeric disassociation temperature of said polymeric contaminant but below a ceramic disassociation temperature of said ceramic coating, thereby destroying said polymeric contaminant within said first region while leaving said ceramic coating substantially intact;

blowing a gas at said first region to expel said polymeric contaminant from said first cell, said gas being at a temperature below said polymeric disassociation temperature to cool said first region;

changing a longitudinal position of said metering roll relative to said laser beam and changing a circumferential position of said metering roll relative to said laser beam at a substantially constant rate of revolutions per unit of time, thereby allowing said first region to cool further to a level below said polymeric disassociation temperature;

focusing said laser beam at a second region of said ceramic coating, said second region being spaced apart from said first region, said second region containing a second cell of said plurality of cells, said second region being at least twice as wide as said widest span of said second cell, said focal point being below said bottom of said second cell when focusing said laser beam at said first region;

raising the temperature of said second region to 400° F. to 1,000° F. which is above said polymeric disassociation temperature but below said ceramic disassociation temperature, thereby destroying said polymeric contaminant within said second region while leaving said ceramic coating substantially intact; and blowing said gas at said second region to expel said polymeric contaminant from said second cell and to cool said second region.

2. A printing press metering roll cleaning apparatus, comprising a metering roll having a metal core with a coating, said coating having a plurality of cells containing a polymeric contaminant, said metering roll being substantially cylindrical and being rotatable about a longitudinal axis, wherein said plurality of cells each have a rounded beveled entryway and a curved bottom surface;

a first drive motor rotating said metering roll about said longitudinal axis;

a guideway substantially parallel to said longitudinal axis;

a laser slidingly attached to said guideway, said laser projecting a laser beam;

a beam expander downstream of and spaced apart from said laser, said beam expander widening said laser beam as said laser beam passes therethrough;

a lens downstream of and spaced apart from said beam expander, said lens focusing said laser beam toward said plurality of cells of said coating, said laser beam raising the temperature of said polymeric contaminant to a level between a disassociation temperature of said polymeric contaminant and a disassociation temperature of said coating, thereby destroying said polymeric contaminant while leaving said coating substantially intact, wherein said lens is associated with a focal point defined as that point in space where said laser beam converges to a minimum width when unobstructed, said lens being farther away from said focal point than said curved bottom surface of at least one of said plurality of cells;

a pressurized fluid directed toward said plurality of cells to expel said polymeric contaminant that has been destroyed by said laser beam;

a second drive motor moving said laser, said beam expander, and said lens in an axial direction substantially parallel to said longitudinal axis, and a guide bearing adjustably fixed relative to said lens and movable relative to said guideway in a direction substantially perpendicular to said longitudinal axis, said guide bearing maintaining a predetermined distance between said coating and said lens regardless of a possible slight out of parallelism between said guideway and said longitudinal axis.

3. A printing press metering roll cleaning apparatus, comprising a metering roll having a metal core with a coating, said coating having a plurality of cells containing a polymeric contaminant, said metering roll being substantially cylindrical and being rotatable about a longitudinal axis;

a first drive motor rotating said metering roll about said longitudinal axis, a guideway substantially parallel to said longitudinal axis;

a laser slidingly attached to said guideway, said laser projecting a laser beam;

a beam expander downstream of and spaced apart from said laser, said beam expander widening said laser beam as said laser beam passes therethrough;

a lens downstream of and spaced apart from said beam expander, said lens focusing said laser beam toward said plurality of cells of said coating, said laser beam raising the temperature of said polymeric contaminant to a level between a disassociation temperature of said polymeric contaminant and a disassociation temperature of said coating, thereby destroying said polymeric contaminant while leaving said coating substantially intact;

a pressurized fluid directed toward said plurality of cells to expel said polymeric contaminant that has been destroyed by said laser beam;

a second drive motor moving said laser, said beam expander, and said lens in an axial direction substantially parallel to said longitudinal axis; and a fluid dynamic guide bearing adjustably fixed relative to said lens and movable relative to said guideway in a direction substantially perpendicular to said longitudinal axis, said fluid dynamic guide bearing maintaining a predetermined distance between said coating and said lens regardless of a possible slight out of parallelism between said guideway and said longitudinal axis, said fluid dynamic bearing being spaced apart from said coating by way of a pressurized fluid cushion, thereby minimizing effects of possible surface irregularity on said coating.

4. A method of cleaning a metering roll of a printing press, said metering having a metal core with a coating, said coating having a plurality of cells each having a widest span and each containing a polymeric contaminant, said method comprising the steps of:

focusing a laser beam at a first region of said coating with said first region containing a first cell of said plurality of cells, said first region being wider than said widest span of said first cell;

raising the temperature of said first region above a polymeric disassociation temperature of said polymeric contaminant but below a coating disassociation temperature of said coating, thereby destroying said polymeric contaminant within said first region while leaving said coating substantially intact;

blowing a fluid at said first region to expel said polymeric contaminant from said first cell, said fluid being at a temperature below said polymeric disassociation temperature to cool said first region;

changing a circumferential position and a longitudinal position of said metering roll relative to said laser beam, thereby allowing said first region to cool further to a level below said polymeric disassociation temperature;

focusing said laser beam at a second region of said coating, said second region being spaced apart from said first region, said second region containing a second cell of said plurality of cells, said second region being wider than said widest span of said second cell;

raising the temperature of said second region above said polymeric disassociation temperature but below said coating disassociation temperature, wherein the temperature of said first region and said second region is raised to a temperature between 400° F. and 1,000° F., thereby destroying said polymeric contaminant within said second region while leaving said coating substantially intact; and blowing said fluid at said second region to expel said polymeric contaminant from said second cell and to cool said second region.

5. A method of cleaning a metering roll of a printing press, said metering roll having a metal core with a coating, said coating having a plurality of cells each having a bottom and a widest span and each containing a polymeric contaminant, said method comprising the steps of:

focusing a laser beam at a first region of said coating with said first region containing a first cell of said plurality of cells, said first region being wider than said widest span of said first cell, wherein said laser beam is focused toward a first focal point defined as that point in space where said laser beam converges to a minimum width if it were unobstructed, wherein said first focal point is below said bottom of said first cell when focusing said laser beam at said first region;

raising the temperature of said first region above a polymeric disassociation temperature of said polymeric contaminant but below a coating disassociation temperature of said coating, thereby destroying said polymeric contaminant within said first region while leaving said coating substantially intact;

blowing a fluid at said first region to expel said polymeric contaminant from said first cell, said fluid being at a temperature below said polymeric disassociation temperature to cool said first region;

changing a circumferential position and a longitudinal position of said metering roll relative to said laser beam, thereby allowing said first region to cool further to a level below said polymeric disassociation temperature;

focusing said laser beam at a second region of said coating, said second region being spaced apart from said first region, said second region containing a second cell of said plurality of cells, said second region being wider than said widest span of said second cell, wherein said laser beam is focused toward a second focal point defined as that point in space where said laser beam converges to a minimum width if it were unobstructed, wherein said second focal point is below said bottom of said second cell when focusing said laser beam at said second region;

raising the temperature of said second region above said polymeric disassociation temperature but below said coating disassociation temperature, thereby destroying said polymeric contaminant within said second region while leaving said coating substantially intact; and blowing said fluid at said second region to expel said polymeric contaminant from said second cell and to cool said second region.

6. A method of cleaning a metering roll of a printing press, said metering having a metal core with a coating, said coating having a plurality of cells each having a widest span and each containing a polymeric contaminant, said method comprising the steps of:

applying a test decal to said metering roll, said test decal having a base material with a dye coating; focusing a laser beam toward said decal; and adjusting said laser beam until said laser beam burns said dye off said decal while leaving most of said base material intact;

focusing said laser beam at a first region of said coating with said first region containing a first cell of said plurality of cells, said first region being wider than said widest span of said first cell;

raising the temperature of said first region above a polymeric disassociation temperature of said polymeric contaminant but below a coating disassociation temperature of said coating, thereby destroying said polymeric contaminant within said first region while leaving said coating substantially intact;

blowing a fluid at said first region to expel said polymeric contaminant from said first cell, said fluid being at a temperature below said polymeric disassociation temperature to cool said first region;

changing a circumferential position and a longitudinal position of said metering roll relative to said laser beam, thereby allowing said first region to cool further to a level below said polymeric disassociation temperature;

focusing said laser beam at a second region of said coating, said second region being spaced apart from said first region, said second region containing a second cell of said plurality of cells, said second region being wider than said widest span of said second cell;

raising the temperature of said second region above said polymeric disassociation temperature but below said coating disassociation temperature, thereby destroying said polymeric contaminant within said second region while leaving said coating substantially intact; and blowing said fluid at said second region to expel said polymeric contaminant from said second cell and to cool said second region.

* * * * *